United States Patent [19]

Lightsey

[11] Patent Number: 4,633,622

[45] Date of Patent: Jan. 6, 1987

[54] SHOT CLEANING APPARATUS WITH GRAVITY FED AUXILIARY IMPELLER

[75] Inventor: Raymond Lightsey, Valdosta, Ga.

[73] Assignee: Walker Peenimpac Machine, Inc., Valdosta, Ga.

[21] Appl. No.: 738,669

[22] Filed: May 28, 1985

[51] Int. Cl.[4] ..... B24C 3/30

[52] U.S. Cl. ..... 51/423; 51/424; 51/426

[58] Field of Search ..... 51/423, 424, 426, 432, 51/417, 420, 436, 429

[56] References Cited

U.S. PATENT DOCUMENTS

| | | | |
|---|---|---|---|
| 2,337,048 | 12/1943 | Huyett et al. | 51/426 |
| 2,708,814 | 5/1955 | Straub | 51/432 |
| 3,047,986 | 8/1962 | McKulla | 51/426 |
| 3,540,155 | 11/1970 | Walker et al. | 51/9 |
| 3,815,287 | 6/1974 | Walker | 51/13 |
| 4,254,593 | 3/1981 | Paulfeuerborn | 51/432 |

*Primary Examiner*—Frederick R. Schmidt
*Assistant Examiner*—Bradley I. Vaught
*Attorney, Agent, or Firm*—Fitzpatrick, Cella, Harper & Scinto

[57] ABSTRACT

A shot cleaning apparatus which includes a housing (10) in which a workpiece (24) is held, main impellers (42) for throwing shot upwardly at the workpiece, auxiliary impellers (73) arranged above the main impellers (42) to throw shot laterally at the workpiece (24) and shot collection assembled in the upper portion of the housing (10) which include V-shaped troughs (84, 86) to collect shot and direct it through feed tubes (92) to feed the shot by gravity to the auxiliary impellers (73).

10 Claims, 4 Drawing Figures

SHOT CLEANING APPARATUS WITH GRAVITY FED AUXILIARY IMPELLER

BACKGROUND OF THE INVENTION

1. Field of the Invention

This invention relates to shot cleaning apparatus and more particularly it concerns improvements involving novel auxiliary impellers and gravity feed systems for such apparatus.

2. Description of the Prior Art

U.S. Pat. No. 3,540,155 shows a shot cleaning apparatus in which a paddle blade impeller is mounted inside a housing to throw shot upwardly in the housing. A workpiece holder, in the form of an open mesh cage, is mounted inside the housing above the impeller in the path of the upwardly thrown shot. After the shot strikes the workpieces inside the cage it falls back down inside the housing and is collected in a hopper. The hopper is located above the center of rotation of the impeller and is constructed and arranged to direct the collected shot, by gravity, back into the rotating impeller which throws the shot back up at the workpiece.

The above described shot cleaning apparatus has the advantage that no moving parts other than the rotating impeller itself are needed for recirculation of the shot. All recirculation is carried out by the action of the impeller blades and by gravity.

Other shot cleaning devices use impellers arranged at various levels and locations around the workpiece so that shot will be thrown at the workpiece from different directions. This ensures that all surfaces of the workpiece will be cleaned by the shot. Such other shot cleaning devices however require special powered shot recirculation systems such as screw conveyors and bucket elevators to transfer the shot back to the various impellers.

SUMMARY OF THE INVENTION

This invention overcomes the above described problems of the prior art and provides a novel shot blast cleaning apparatus which not only ensures that workpieces will be treated on all surfaces by also is very simple in structure and eliminates the need for complex shot recirculation conveyors and elevators. According to this invention the energy imparted to the shot by the main impellers is used to transfer the shot to auxiliary impellers which are arranged to direct the shot at the workpiece from various directions.

The shot cleaning apparatus of this invention comprises an outer housing, at least one main shot blast impeller mounted in the lower part of the housing to throw shot in an upward direction relative to the main shot blast impeller in the housing, workpiece holding means in the housing above the main impeller for holding a workpiece in the path of the shot thrown by the main impeller, a main hopper arranged in the housing below the workpiece holding means to collect shot falling in the housing and to direct the collected shot to the main impeller, an auxiliary impeller located above the main impeller and arranged to throw shot in a direction other than said upward direction at a workpiece held in the housing and a shot collection assembly mounted in the housing above the auxiliary impeller to collect shot incident thereon and to direct the collected shot by gravity to the auxiliary impeller. The collection assembly comprises an elongated collection trough slanted relative to a horizontal direction and a feed tube.

A lower portion of the trough opens to one end of the feed tube and the feed tube extends downwardly from its one end to the auxiliary impeller.

BRIEF DESCRIPTION OF THE DRAWINGS

A specific embodiment of the invention has been chosen for purposes of illustration and description, and is shown in the accompanying drawings forming a part of the specification, wherein.

DETAILED DESCRIPTION OF THE PREFERRED EMBODIMENT

Figure 1:
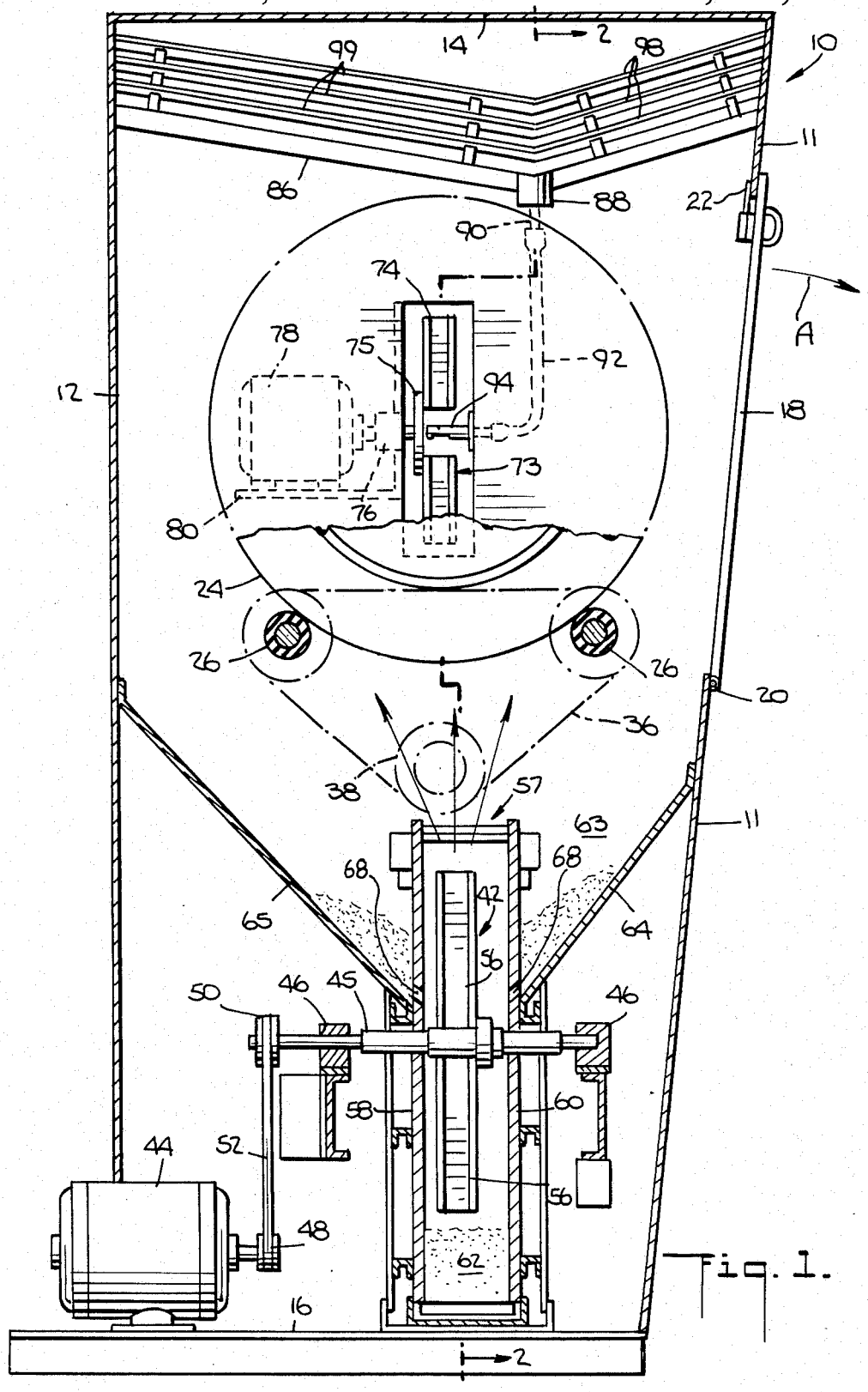
FIG. 1 is a side elevational section view of a shot cleaning apparatus according to the present invention and taken along line 1—1 of FIG. 2.

As shown in FIG. 1, the shot cleaning apparatus includes an outer housing 10 made up of a front wall 11, a back wall 12, a top wall 14 and a bottom wall 16. A door 18 is mounted on the front wall 11 by means of a lower hinge 20. A latch 22 is provided at the upper end of the door 18 to hold it closed. The latch may be released to allow the door to open in the direction of the arrow A to allow workpieces 24 to be inserted into and withdrawn from the housing.

The invention in particularly useful for shot cleaning of cylindrical tanks used to contain gas such as liquid propane. Such a cylindrical workpiece 24 is shown in FIG. 1 as resting on a pair of spaced apart support rollers 26 inside the housing 10.

Figure 2:
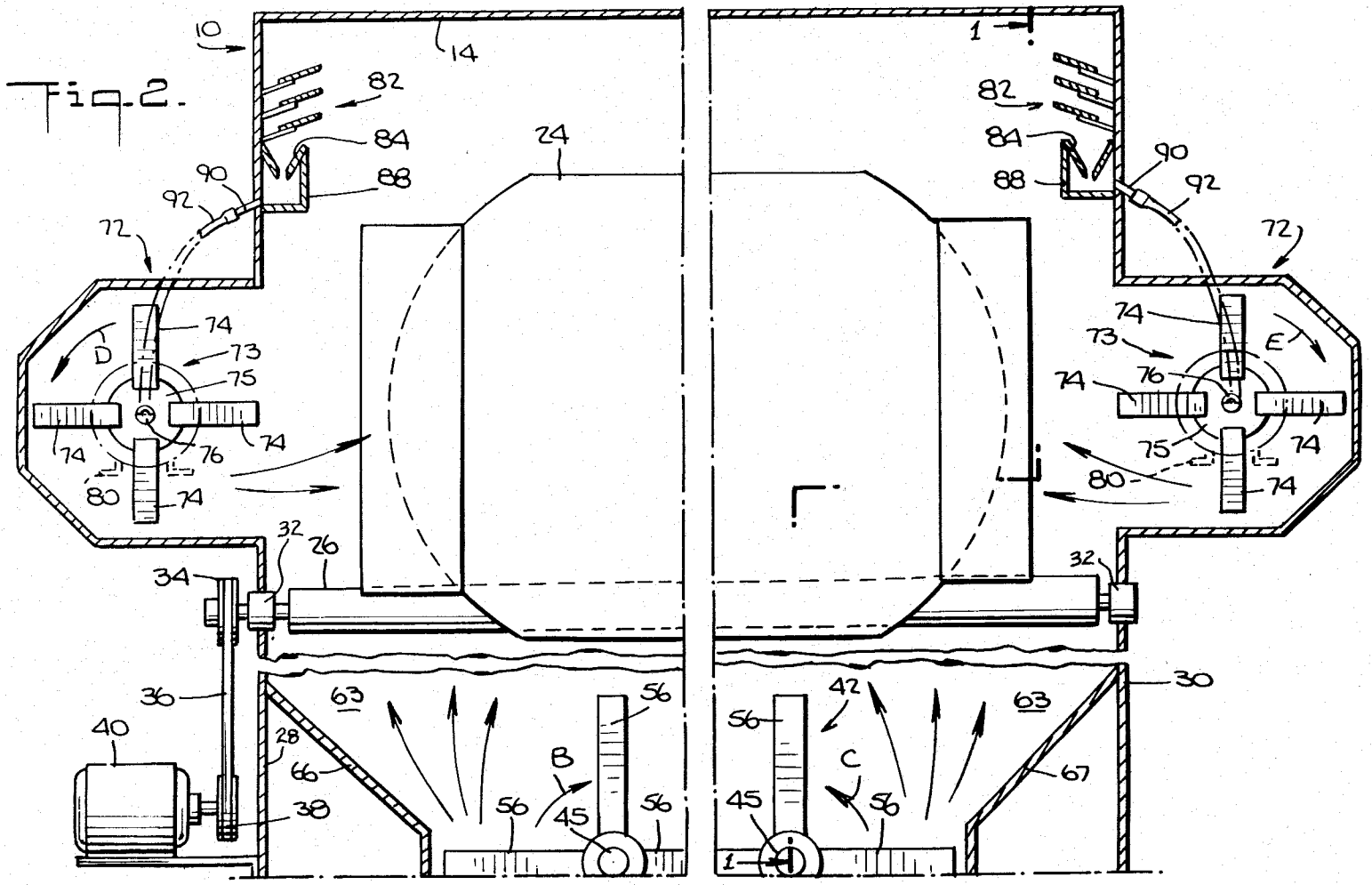
FIG. 2 is a fragmentary front elevational view of the shot cleaning apparatus of FIG. 1 and taken along line 2—2 of FIG. 1.

Turning now to FIG. 2, it will be seen that the housing 10 is closed by means of side walls 28 and 30. Bearings 32 are mounted in the sidewalls 28 and 30; and these bearings support the ends of the rollers 26. A pulley or sprocket 34 is provided at one end of each roller 26 and is driveably connected by means of a belt or chain 36 to a drive pulley or sprocket 38 on a roller drive motor 40. It will be seen that the motor 40 turns the support rollers 26 in the same direction and these in turn cause the workpiece cylinder 24 to rotate about its longitudinal axis.

Below the workpiece cylinder 24 there are provided a pair of main impellers 42. These are driven in mutually opposite directions, as indicated by the arrows B and C in FIG. 2, by means of a main impeller motor 44 (FIG. 1). As can be seen in FIG. 1 the main impellers 42 each have a shaft 45 which is supported in bearings 46 inside the housing 10; and the motor 44 drives the shaft 45 via pulleys or sprockets 48 and 50 and a drive belt or chain 52. The main impellers have paddle-like blades 56 which throw shot upwardly in the housing against the bottom of the rotating workpiece cylinder 24. As the workpiece cylinder rotates, its entire circumference becomes exposed to an is treated by the upwardly thrown shot.

The main impellers 42 are mounted to turn inside a main impeller housing 57 formed by vertical walls 58 and 60 (FIG. 1). These walls serve to guide the shot that is thrown by the impellers and ensure that it is directed upwardly in the housing 10. Also, as can be seen in FIG. 1 the lower portion of the main impeller housing forms a reservoir 62 into which shot accumulates in a region in the path of the rotating impeller blades. Thus, when the shot cleaning machine is put into operation and the main impeller blades 56 begin to turn inside the housing 57, they produce a driving action on the shot contained therein to force the shot up out of the impeller housing both by direct action on the shot and by fan induced air currents in the impeller housing.

Inside the main housing 10 there is formed a main collection hopper 63 comprising front and rear slanted walls 64 and 65 (FIG. 1) and side slanted walls 66 and 67 (FIG. 2). These walls all slant upwardly and outwardly from the main impeller housing 57 to the front, back and side walls 11, 12, 28 and 30, respectively, of the main housing 10. The main collection hopper 63 collects all shot that falls down inside the housing 10 and directs it into the main impeller housing 57. Also, as shown in FIG. 1 the front and rear walls 64 and 65 of the main collection hopper 63 direct the shot through slots 68 in the walls 66 and 67 near the shafts 45 of the main impellers 42 so that the shot will be directed into the path of the impeller blades 56 near the shafts 45. This places the shot onto the portion the impeller blades 56 which is moving at the slowest linear velocity. As the blade rotates the shot moves toward the blade tip and is ultimately thrown off at very high velocity. This shot feed arrangement minimizes wear on the blades 56 and on the shot itself.

The shot cleaning apparatus as thus far described is part of the prior art and has proven to be effective and efficient in the shot cleaning large cylindrical objects such as gas cylinders. One especially beneficial feature of this apparatus is that no moving parts are required for recirculation of the shot. Rather, the shot is thrown upwardly by the main impellers and is returned by gravity and is redirected by the hopper arrangement back to the impellers so that it can be thrown again at the workpiece.

The improvement provided by present invention makes it possible to clean cylindrical workpieces in a substantially shorter amount of time than was previously required with shot cleaning devices of this type. Moreover, with the present invention no special shot conveyors with moving parts are required and the construction of the apparatus remains uncomplicated, efficient and long wearing.

As shown in FIG. 2, there are provided in each of the sidewalls 28 and 30, at about the height of the workpiece 24, an auxiliary impeller housing 72. An auxiliary impeller 73 is mounted to rotate in each auxiliary impeller housing. Each auxiliary impeller housing 72 surrounds its respective auxiliary impeller 73 except in the direction of the end of the workpiece 24. The auxiliary impellers 73 are of the same general construction as the main impellers 42 and are formed with paddle blades 74. The paddle blades 74 are affixed to a steel disk 75 which in turn is mounted on a drive shaft 76. The drive shafts 76 are mounted parallel to the shafts 45 of the main impellers 42. The drive shafts 76 are directly driven by auxiliary impeller drive motors 78 mounted on brackets 80 just outside each auxiliary impeller housings 72. The auxiliary impellers 73 are driven such that, as viewed in FIG. 2, the left impeller turns counterclockwise and the right impeller turns clockwise, as shown by arrows D and E respectively. Thus the lower portion of each auxiliary impeller 73 throws shot laterally and inwardly against one end of the workpiece cylinder 24.

Figures 3, 4:
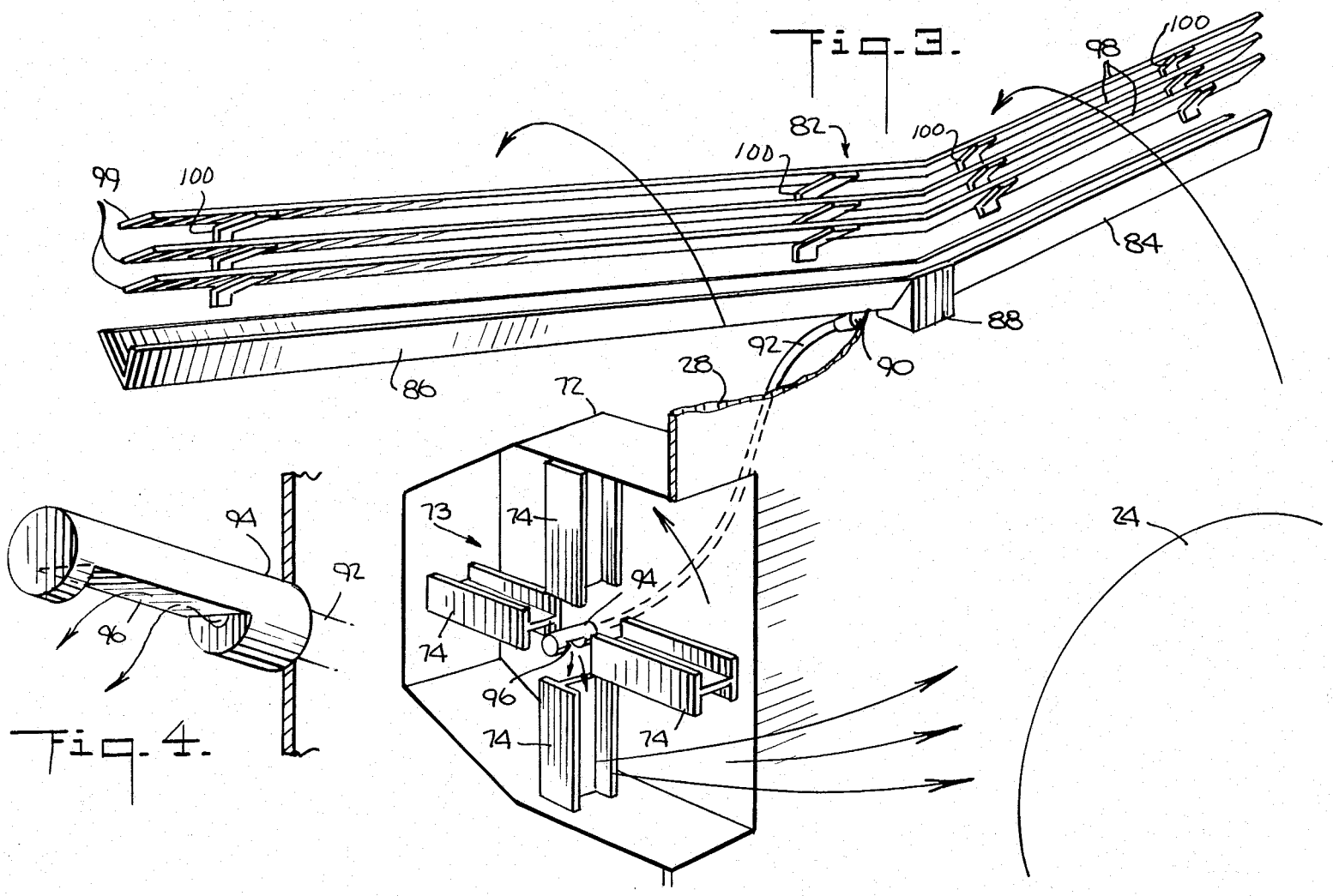
FIG. 3 is a fragmentary perspective view showing a shot collection and side impeller feed arrangement used in the shot cleaning apparatus of FIG. 1.
FIG. 4 is an enlarged fragmentary view showing a shot feed element used in the side impeller feed arrangement of FIG. 3.

An auxiliary rotor shot collection assembly 82 is mounted inside the housing 10 near the upper end of each of the side walls 28 and 30. These shot collection assemblies each comprise front and rear V-shaped elongated troughs 84 and 86 positioned with one side edge adjacent the associated side wall 28 or 30. The front and rear troughs 84 and 86 slant downwardly from the front and back walls 11 and 12, respectively, to where the troughs meet, above and forwardly of the associated auxiliary impeller 73. The lower ends of the two V-shaped elongated troughs 84 and 86 open to an auxiliary collection hopper 88 which is also positioned adjacent the associated side wall 28 or 30. As shown in FIGS. 2 and 3, the collection hopper 88 is provided with an outlet pipe 90 which extends from the interior of the hopper 88 out through the associated side wall 28 or 30. A feed tube 92 is connected to the outlet pipe 90 and extends down along the outside of the associated auxiliary impeller housing 72 to a location directly opposite the impeller drive shaft 76. The feed tube 92 is connected to a pipe-like feed element 94 which extends into the housing 72 along the axis of rotation of the auxiliary impeller 73. As shown in FIG. 4, the feed element 94 is a hollow cylinder formed with a cutaway 96 which exposes the hollow interior to the outside for the major portion of the length of the element. The cutaway 96 faces downwardly so that as shot passes into the feed element 94 from the feed tube 92 it drops down from the feed element into the path of the rotating blades 74 of the auxiliary impeller 73. As can be seen in FIG. 3 the shot is fed to the auxiliary impellers 73 from a location near their axes. As in the case of the main impellers 42, this allows the auxiliary impellers to throw the shot with minimum of shock to either the impeller blades or to the shot itself.

Reverting now to FIG. 3 it will be seen that each auxiliary rotor shot collection assembly 82 is also provided with a plurality of vertically spaced apart slats 98 and 99 arranged parallel to the V-shaped elongated troughs 84 and 86. The slats 98 and 99 are mounted on brackets 100 which hold them spaced slightly away from the associated housing side wall 28 or 30. The slats 98 and 99 are also held so that they tilt downwardly toward their associated side wall. This arrangement serves to direct shot which falls on each slat 98 to fall toward the adjacent side wall and then down into the V-shaped trough.

In operation of the above described shot cleaning apparatus the roller drive motor 40 causes the support rollers 26 to slowly rotate the workpiece cylinder 24 along its horizontal axis. At the same time the main impeller motor 44 turns the main impellers 42 so that they drive shot out of the lower part of the main impeller housing 57 and throw it upwardly against the rotating workpiece cylinder. The shot impinging against the workpiece cleans scale and accumulations off its surfaces and cleans it. The shot then falls down inside the housing 10 and is collected and directed by the main collection hopper 63 back to the main impellers 42 which throw the shot back up at the workpiece cylinder.

The present invention makes use of the discovery that during the above described operation a rather substantial amount of shot is thrown into the upper regions of the housing 10 and that this shot can be collected and fed by gravity to auxiliary impellers which are arranged to throw it against the ends of the workpiece. The portion of this shot which encounters any of the slats 98 or the V-shaped troughs 84 and 86, is directed by them into the auxiliary collection hopper 88 and from there through the outlet pipe 90 and the feed tube 92 to the feed element 94 which then directs the shot into the path of the associated auxiliary impeller 70. The auxiliary impeller 70 then throws this shot directly against the end of the cylindrical workpiece 24.

It has been found that by arranging the auxiliary impellers so that they throw shot directly at the ends of the cylindrical workpiece, the ends of the workpiece can be treated more fully and quickly than was previously possible. Moreover the auxiliary impeller arrangement makes it possible to provide complete cleaning of flanged end type gas cylinders such as shown in the drawings.

It has also been found that the auxiliary impellers 73 may be arranged with their axes extending in a direction other than horizontal; and that with such an arrangement the possibility of shot clogging the feed tube 92 in the vicinity of the feed element 94 is minimized. In a preferred arrangement, the auxiliary impellers 73, their housing 72, their motor support brackets 80, their drive motors 78 and their feed elements 94 are all tilted counter-clockwise by about 25°, as viewed in FIG. 1, so that the feed elements 94 extend downwardly from the horizontal. This decreases the sharpness of the bend in the feed tube 92 where it meets the feed element 94 and allows free flow of shot to the feed element. It will be appreciated that with this arrangement the shot is still thrown laterally at the workpiece 24 by the auxiliary impellers 73.

The invention is not limited to the cleaning of gas cylinders. Many other objects can be treated with this invention and various types of support means may be provided. For example, the housing 10 may be provided with openings in the front and back walls which allow objects supported from an overhead conveyor to pass through the housing and become shot cleaned during their traversal through the housing.

It will also be appreciated that with this invention no moving part conveyors, elevators or the like are needed to supply shot to the auxiliary impellers. The energy for supplying the shot to the auxiliary impellers comes from the action of the main impellers in throwing the shot up into the upper portion of the housing.

I claim:

1. A shot cleaning apparatus comprising an outer housing, at least one main shot blast impeller mounted in the lower part of said housing to throw shot in an upward direction relative to said main shot blast impeller in the housing, workpiece holding means in said housing above the main impeller for holding a workpiece in the path of shot thrown by said main impeller, a main hopper arranged in the housing below the workpiece holding means to collect shot falling in the housing and to direct the collected shot to the main impeller, an auxiliary impeller located above said main impeller and arranged to throw shot in a direction other than said upward direction at a workpiece held in said housing and a shot collection assembly mounted in said housing above said auxiliary impeller to collect shot thrown incident thereon by said main shot blast impeller and to direct the collected shot by gravity to the auxiliary impeller, said shot collection assembly comprising an elongated collection trough slanted relative to a horizontal direction and a feed tube, a lower portion of said trough opening to one end of said feed tube, said feed tube extending downwardly from said one end to said auxiliary impeller.

2. A shot cleaning apparatus according to claim 1 wherein said auxiliary impeller is a paddle blade type impeller mounted to rotate about an axis and wherein said feed tube is arranged to feed shot into the path of the paddle blades of said auxiliary impeller near said axis.

3. A shot cleaning apparatus according to claim 2 wherein an auxiliary impeller housing surrounds said auxiliary impeller and opens in the direction of said workpiece.

4. A shot cleaning apparatus according to claim 1 wherein a plurality of auxiliary impellers are provided to direct shot at the workpiece from different directions.

5. A shot cleaning apparatus according to claim 1 wherein said trough is positioned adjacent a wall of said housing.

6. A shot cleaning apparatus according to claim 5 wherein there are provided at least one slat above and parallel to said trough.

7. A shot cleaning apparatus according to claim 6 wherein said slat is spaced away from said wall of said housing and is tilted downwardly toward said wall.

8. A shot cleaning apparatus according to claim 7 wherein there are provided a plurality of slats parallel to said trough and spaced apart from each other in a vertical direction.

9. A shot cleaning apparatus according to claim 2 wherein said feed tube slants downwardly relative to a horizontal direction at a location where it joins said auxiliary impeller.

10. A shot cleaning apparatus according to claim 9 wherein the axis of said auxiliary impeller is also tilted relative to a horizontal direction.

* * * * *

UNITED STATES PATENT AND TRADEMARK OFFICE

CERTIFICATE OF CORRECTION

PATENT NO. : 4,633,622

DATED : January 6, 1987

INVENTOR(S) : Raymond Lightsey

It is certified that error appears in the above-identified patent and that said Letters Patent is hereby corrected as shown below:

IN THE ABSTRACT

Line 6, "assembled" should read --assembly--.

IN THE DESCRIPTION

Column 2, line 62, "an is" should read --and is--.

Column 3, line 25, "the" should read --of the--.

Column 3, line 33, "large" should read --of large--.

Signed and Sealed this

Twenty-second Day of September, 1987

*Attest:*

DONALD J. QUIGG

*Attesting Officer* *Commissioner of Patents and Trademarks*